United States Patent [19]

Suchy

[11] Patent Number: 4,799,667

[45] Date of Patent: Jan. 24, 1989

[54] PHYSICAL EXERCISE APPARATUS

[75] Inventor: Helmut Suchy, Salzburg, Austria

[73] Assignee: Gyroteq Corporation, Minneapolis, Minn.

[21] Appl. No.: 159,233

[22] Filed: Feb. 23, 1988

Related U.S. Application Data

[63] Continuation of Ser. No. 884,222, Jul. 10, 1986.

[30] Foreign Application Priority Data

Aug. 7, 1985 [AT] Austria ..... 2308/85
Aug. 26, 1985 [AT] Austria ..... 2477/85

[51] Int. Cl.[4] ..... A63B 25/08; A63G 1/00

[52] U.S. Cl. ..... 272/36; 272/114; 280/206

[58] Field of Search ..... 272/114, 115, 93, 126, 272/33 R, 36, 144, 132, 1 R; 280/206, 207, 208; 128/25 R; 434/55

[56] References Cited

U.S. PATENT DOCUMENTS

| | | | |
|---|---|---|---|
| 2,923,545 | 2/1960 | Lytle | 280/206 |
| 3,013,806 | 12/1961 | Boyd | 280/206 |
| 3,083,037 | 3/1963 | Gordon et al. | 280/206 |
| 3,141,669 | 7/1964 | Yun Chul | 272/36 |
| 3,276,777 | 10/1966 | Pruitt Sr. | 272/36 |
| 4,232,662 | 11/1980 | Barber | 272/144 |

FOREIGN PATENT DOCUMENTS

| | | | |
|---|---|---|---|
| 1159660 | 2/1958 | France | 272/36 |

*Primary Examiner*—Vincent Millin
*Assistant Examiner*—S. R. Crow
*Attorney, Agent, or Firm*—Tilton, Fallon, Lungmus and Chestnut

[57] ABSTRACT

The invention relates to a physical exercise apparatus comprising three nested frame elements mounted inside one another for rotation about axes offset by 90° from one another. The thus established gimbal mounting of the frame elements permits a person occupying the innermost frame element to assume any angular position in space solely by displacing his weight to thereby fortify his muscles an improve his sense of equilibrium.

4 Claims, 2 Drawing Sheets

PHYSICAL EXERCISE APPARATUS

RELATED APPLICATION

This application is a continuation of application Ser. No. 884,222 filed July 10, 1986.

The present invention relates to a physical exercise apparatus comprising a first, inner frame element serving as a carrier for an occupant and mounted in a second, larger frame element for rotation about a first axis, said second frame element being itself mounted in a third frame element for rotation about a second axis extending transversely of the first axis.

A physical exercise apparatus of this type is already known from U.S. Pat. No. 3,936,047. This apparatus is used for envigorating and training of muscle complexes and for improving the sense of equilibrium of a person occupying the inner frame element.

In the known physical exercise apparatus, a motor drive assembly is used for rotating the inner frame element about a first axis relative to the larger second frame element. The larger frame element is itself mounted for rotation in a third frame element. This known embodiment does not, however, offer the trainee the possibility of three-dimensional displacement. The trainee is restricted in his movements due to not being able to freely move his hands and upper part of his body. The usefulness of the apparatus is further restricted by the fact that the rotation of the inner frame element is brought about with the aid of a motor.

Apart from the physical exercise apparatus of the type defined above, there is a further sports implement known under the name of rhoenrad, which basically permits movements only in a single plane of rotation.

It is an object of the present invention to improve a physical exercise apparatus of the type defined above with a view to widen the range of movement of a trainee.

In accordance with the invention, this object is attained by the provision that the third, outer frame element is mounted for rotation about a third axis extending perpendicular to the second axis, so that the thus constituted gimbal mounting permits a person occupying the inner frame element to assume any angular position in space solely by displacement of his weight.

The physical exercise apparatus according to the invention offers the advantage that by rotational movements of his body, a trainee is able within a few minutes to warm up, exercise and strengthen all of his muscle complexes. The gimbal mounting of the apparatus enables the trainee to occupy any position in space, it being important in this context that this may be achieved solely by displacements of the trainee's weight. None of the frame elements is driven from an exterior source.

In a very advantageous practical embodiment, the invention provides that the three frame elements are formed as nested rings. The rings may be made of round tubular sections, it being also possible, of course, to employ flat steel ribbon or any other suitable material for this purpose.

In a further advantageous embodiment the invention provides that the outer ring is mounted on a ground-engaging support for rotation about the third axis. This mounting of the outer ring on a ground-engaging support permits the physical exercise apparatus to be erected in a simple manner in a confined space and at any location of use.

Protection walls may be installed for preventing spectators or other persons in the vicinity of the apparatus from entering the orbits of the rings. In any case, the ground-engaging support ensures safe and simple erection of the apparatus.

In a further embodiment of the invention, the first, innermost ring is provided with footrests equipped with adjustable retaining rollers for retaining the feet of an occupant. A person intending to use the apparatus for exercise or training simply steps onto the footrests. The foot may then be retained by the retaining roller engaging the instep and by a cushioning provided at the heel portion, so that there is no danger for the trainee to slip off the footrest. The same effect may of course also be accomplished by retaining straps, although the retaining rollers, which are preferably made of a plastic foam or a similarly yielding material, offer the possibility of a simple adjustment to feet of different sizes. The footrests themselves or the retaining rollers may of course be adjustable mounted on the innermost ring in a manner permitting optimum adjustment to the size of any trainee. In any case, the pressure-engageable retaining retaining rollers or retaining straps will ensure that the trainee is safely retained on the footrests and does not slip off even at high speeds of rotation.

Within the innermost ring there is preferably provided a support loop mounted at hip level of an occupant and connected to the innermost ring by struts. The support hoop mounted at hip level serves likewise for safely supporting the occupant's body, and is preferably adjustable in height to thus permit a further adjustment to the size of different trainees.

The struts extend from the support loop to the ring preferably at a diverging angle so as to permit the person using the physical exercise apparatus to stand with his legs slightly apart.

According to a further aspect of the invention, grip handles may be provided adjacent the support loop. In this case, the user of the apparatus may hold on to these grip handles for bending the upper part of his body in any direction. As an alternative, the innermost ring may be provided with grip bars located opposite the footrests for the user to grasp. At the location of such grip bars there may also be provided loops or the like for the user to insert his wrists therethrough.

According to a further aspect the invention provides that protection covers are provided at least adjacent the grip bars so as to prevent an occupant from grasping beyond the radius of the inner ring. A protection cover of this type may for instance be formed of an organic glass material or the like in a spherical shape so as to extend on both sides of the ring at the location of the grip bars. In the event of the user's hand slipping off the grip handles or releasing them, the protection cover prevents the hand from getting into the orbit of the second, intermediate ring, and thus serves as a safeguard for the user.

According to a further aspect of the invention, the respective mounting consists of bearing supports secured to the rings, bearings threadedly secured to the supports, and axle pins secured to the rings. A mounting of this type may be readily disassembled, so that the assembly of the physical exercise apparatus at the location of use is greatly facilitated.

An embodiment of the invention shall now be described by way of example with reference to the accompanying drawings, wherein.

Figure 1:
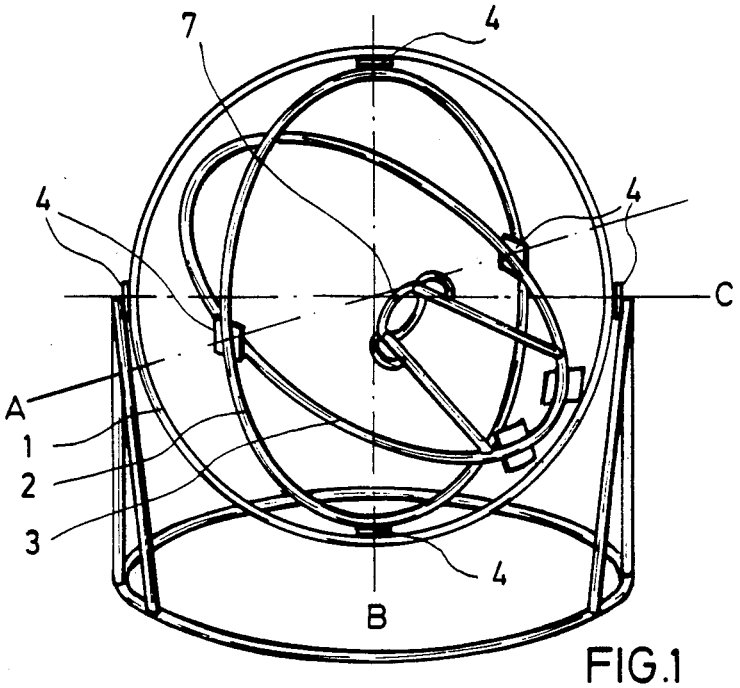
FIG. 1 shows a front view of the physical exercise apparatus.

They physical exercise apparatus shown in FIG. 1 has a first, inner ring 3 mounted in an intermediate ring 2 for rotation about an axis A. The second or intermediate ring 2 is itself mounted in a third ring 1 for rotation about a second axis B extending perpendicular to axis A. The outer ring 1, which has the greatest diameter of the three rings, is again mounted on a ground-engaging support 14 for rotation about a third axis C extending perpendicular to second axis B. Ground-engaging support 14 consists of a large-diameter ring made of a round tubular material and resting on the ground, and a pair of support risers 15 disposed at opposite locations and carrying the ring assembly 1,2,3. At the location of the respective axes A, B and C, the rings are carried by bearing assemblies 4 for rotation relative to the respective adjacent ring, the bearing assemblies 4 being offset with respect to one another by an angle of 90° for each consecutive ring. Depending on the height of a room, outer ring 1 may also be mounted in the ceiling or a wall of a room.

Figure 2:
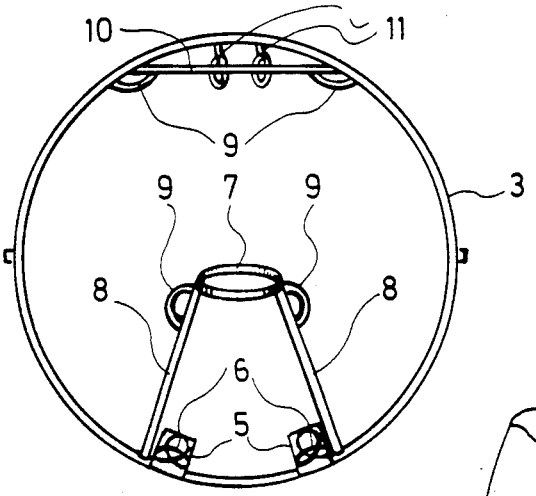
FIG. 2 shows the inner ring thereof.

As shown in FIG. 2, innermost ring 3 is provided with two footplates 5 and, in the embodiment shown, retaining straps 6 for retaining the feet of the user. Also provided within ring 3 is a support hoop 7 connected to ring 3 through struts 8. Struts 8 diverge from support hoop 7 towards ring 3 to which they may be secured as by welding. In a practical embodiment of the invention support hoop 7 may be secured to struts 8 in a vertically adjustable manner. Grip handles 9 are secured to struts 8 adjacent support hoop 7.

At a location substantially opposite footrests 5 ring 3 is provided with a grip bar 10 in the form of a secant. Also provided at this location are flexible loops 11.

Figure 3:
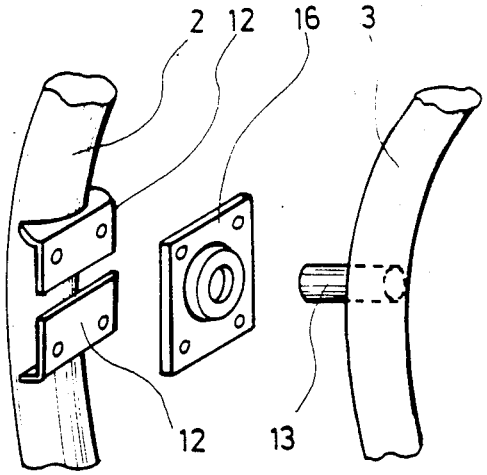
FIG. 3 shows the mounting of a ring on the adjacent ring.

FIG. 3 shows an example of a bearing assembly 4. The bearing assembly or mounting comprises a bearing support 12 fixedly secured to intermediate ring 2 in the example shown. A bearing 16 is to be bolted to bearing support 12 and receives therein an axle pin 13 secured to inner ring 3 in the example shown. For assembling the bearing assembly, bearing 16 is first mounted on axle pin 13 and subsequently bolted to bearing support 12.

All of the bearing assemblies 4 shown in FIG. 1 may be of this construction, it being of course possible to achieve similar results with bearings of different design.

Figure 4:
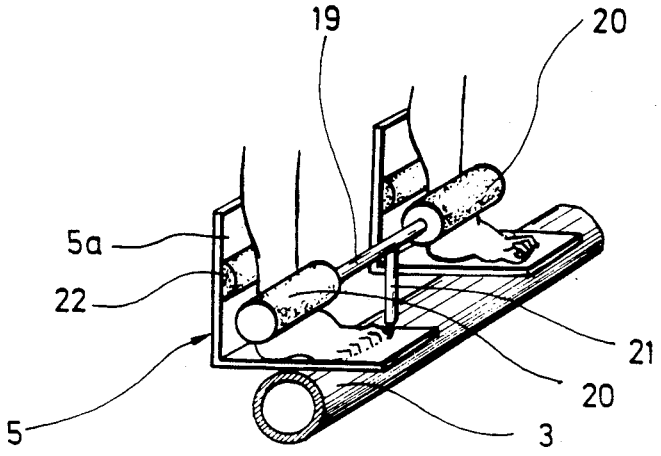
FIG. 4 shows a perspective illustration of an embodiment of a footrest with foot retaining means.

An alternative possibility for retaining the feet of the user is shown in FIG. 4. The embodiment shown comprises a shaft 19 carrying a pair of retaining rollers 20 made of a plastic foam or a similarly yielding material. A support 21 of shaft 19 is secured to inner ring 3 as by being welded thereto. The height of rollers 20 is adjustable in a not shown manner, as is preferably also their spacing from an upright portion 5a of footrest 5. Secured to the inner wall surface of upright portion 5a is a cushioning material, for instance a plastic foam, so that the described retaining assembly is capable of safely and comfortably retaining the feet of the user between rollers 20 and cushion 22.

For use of the physical exercise apparatus, the trainee passes his legs through support hoop 7 and adjusts the footrest and/or the support hoop to a suitable height, whereupon he secures his feet to the footrest by means of retaining straps 6 or by suitably adjusting retaining rollers 20. With his hands he may selectively grasp the grip handles 9 secured to struts 9, grip bar 10 or loops 11.

Due to the 90° offset of the respective mounting locations, the trainee now occupies a ginbals-mounted inner ring permitting him to assume any angular position in space merely by displacement of the weight particularly of the upper part of his body.

For preventing the hands of the user from getting into the orbit of second ring 2 in the event of their slipping off grip bar 10, and to thus avoid the danger of injuries, the inner ring may be provided with protective covers, preferable of a spherical shape, at the location of grip bar 10, such protective covers being not, however, shown in the drawings.

The describes embodiment may of course be modified in various manners within the scope of the invention. Thus the inner ring does not necessarily have to be a completely closed ring and may be replaced for instance by a half-circular ring segment when it is not intended that the occupant should get a hold for his hands above his head. It would also be conceivable for instance to replace the individual rings by spherical bodies made of an organic glass material or the like and rotatably mounted inside one another.

I claim:

1. A physical exercise apparatus comprising a first innermost ring (3) which is mounted rotatably about a first axis (A) in a second larger ring (2), and with a third outermost ring with respect to which the second ring (2) is in turn mounted rotatably about a second axis (B) pointing transversely to the first axis (A) and the third outermost ring (1) being mounted rotatably about a third axis (C) so that an occupant occupying the first innermost ring can assume any angular position in space solely by weight shifting or movement due to the mounting of gimbals effected thereby, characterized in that a support hoop (7) is disposed in the first innermost ring at the level of an occupant's hip, which is connected via rigid struts (8) to the innermost ring (3) said struts being positioned to provide the sole support for said support hoop so that the occupant may support himself for substantially effecting rotational movement solely by gripping the support hoop and may use the support hoop for introducing forces onto the innermost ring by movement of the occupant.

2. A physical exercise apparatus according to claim 1, characterized in that the outer ring (1) is mounted about the third axis (C) in a ground-engaging support.

3. A physical exercise apparatus according to claim 1 or 2, characterized in that footrests (5) with adjustably disposed retaining rollers (6) for retaining feet are provided in the first innermost ring.

4. A physical exercise apparatus according to claim 1, characterized in that the struts (8) extend at a divergent angle from the support hoop (7) to the ring.

* * * * *

UNITED STATES PATENT AND TRADEMARK OFFICE

CERTIFICATE OF CORRECTION

PATENT NO. : 4,799,667

DATED : January 24, 1989

INVENTOR(S) : Helmut Suchy

It is certified that error appears in the above-identified patent and that said Letters Patent is hereby corrected as shown below:

Column 2, line 20, delete "adjustable" insert --adjustably--.

Column 3, line 8, delete "They" insert --The--.

Column 4, line 23, delete "describes" insert --described--.

Signed and Sealed this

Fourth Day of July, 1989

*Attest:*

*Attesting Officer*

DONALD J. QUIGG

*Commissioner of Patents and Trademarks*